US012344965B2

(12) United States Patent
Gong et al.

(10) Patent No.: US 12,344,965 B2
(45) Date of Patent: Jul. 1, 2025

(54) ANTIBACTERIAL TEXTILE AND PREPARATION METHOD THEREOF

(71) Applicants: LuoLai Lifestyle Technology Co., LTD., Nantong (CN); Shanghai Luolai Lifestyle Technology Co., Ltd., Shanghai (CN)

(72) Inventors: Huairui Gong, Shanghai (CN); Liangping Xu, Shanghai (CN)

(73) Assignees: LuoLai Lifestyle Technology Co., LTD., Nantong (CN); Shanghai Luolai Lifestyle Technology Co., Ltd., Shanghai (CN)

( * ) Notice: Subject to any disclaimer, the term of this patent is extended or adjusted under 35 U.S.C. 154(b) by 740 days.

(21) Appl. No.: 17/712,077

(22) Filed: Apr. 2, 2022

(65) Prior Publication Data

US 2022/0333278 A1 Oct. 20, 2022

Related U.S. Application Data

(63) Continuation of application No. PCT/CN2021/117313, filed on Sep. 8, 2021.

(30) Foreign Application Priority Data

Apr. 7, 2021 (CN) ..... 202110372890
Apr. 7, 2021 (CN) ..... 202110373971
Apr. 7, 2021 (CN) ..... 202110373980

(51) Int. Cl.
*D02G 3/44* (2006.01)

(52) U.S. Cl.
CPC ..... *D02G 3/449* (2013.01); *D10B 2201/01* (2013.01); *D10B 2201/02* (2013.01); *D10B 2201/10* (2013.01); *D10B 2331/04* (2013.01); *D10B 2401/13* (2013.01)

(58) Field of Classification Search
CPC ..... D02G 3/449; D10B 2201/01; D10B 2201/02; D10B 2201/10; D10B 2331/04; D10B 2401/13
See application file for complete search history.

(56) References Cited

FOREIGN PATENT DOCUMENTS

CN 102258064 A 11/2011
CN 212834339 U * 3/2021 ..... D04B 1/10

* cited by examiner

*Primary Examiner* — Amina S Khan

(57) ABSTRACT

An antibacterial textile and a preparation method thereof are provided. The antibacterial textile provides advantages as follows: various sources for raw material ingredients; low cost and good antibacterial effect; safe and eco-friendly; simple in preparation method; and easy operation. Therefore, the present invention is widely applicable in industrial production.

10 Claims, 3 Drawing Sheets

ANTIBACTERIAL TEXTILE AND PREPARATION METHOD THEREOF

CROSS REFERENCE TO RELATED APPLICATION

The present application is a continuation application of PCT/CN2021/117313 filed on Sep. 8, 2021. PCT/CN2021/117313 is related to and claims the benefit of priorities of the following Chinese applications: serial No. 202110373980.X, No. 202110372890.9, and No. 202110373971.0, all filed on Apr. 7, 2021. The disclosures of the forgoing applications are hereby incorporated by reference in their entirety, including any appendices or attachments thereof, for all purposes.

FIELD OF THE INVENTION

The present invention belongs to the field of textile technology, and particularly relates to an antibacterial textile and a preparation method thereof.

Description of the Prior Art

Household textiles, such as beddings and leisurewear, and bathroom textiles, such as towel products, are used very frequently and, thus, easily breed bacteria and cause unpleasant odors. Unfortunately, commercially-available antibacterial textiles hardly satisfy the demands for plump texture, soft hand feel, fluffy property, moisture absorption, and long-lasting antibacterial effect.

Generally, the method for obtaining antibacterial properties of fabrics includes three post-finishing ways. (1) An antibacterial finishing agent is bonded on the fabrics according to a certain process. This hardly achieves the indicators of antibacterial properties, hand feel, and endurance quality simultaneously. (2) An antibacterial fiber is added to obtain antibacterial yarns for weaving and then obtaining fabrics. The shortcoming is that the added antibacterial fibers, such as bamboo, flax, and chitin, have poor antibacterial properties and thus, need to be added to the fabrics in large amounts, up to at least 30% above, thereby greatly influencing the comfort and hand feel of the textiles. (3) Surface metal sputtering, for example, a fabric plated with a silver layer on the surface thereof. The fabric surface obtained in such a way has an obvious metal texture and is unsuitable for household textiles and bathroom textiles. Therefore, it is essential to provide a textile capable of satisfying the above requirements simultaneously.

SUMMARY OF THE INVENTION

In view of the above shortcomings in the prior art, the objective of the present invention is to provide an antibacterial textile, thus solving the problems of hardly satisfying the demands for plump texture, soft hand feel, fluffy property and moisture absorption, and durable antibacterial effect in the existing household textiles and bathroom textiles.

To achieve the above objective and other relevant objectives, the present invention provides an antibacterial textile. The antibacterial textile is made of an antibacterial fiber; the antibacterial fiber is treated by an antibacterial treatment fluid; and the antibacterial treatment fluid includes a polyquaternary ammonium salt (PQAS), an aloe extract, alcohol, a humectant and deionized water.sss The antibacterial fiber includes one or a combination of more of antibacterial polyquaternary ammonium salt/aloe fiber, vinyl monomer grafting modified-antibacterial fiber and *Lysimachia christinae* Hance fiber.

As mentioned above, the present invention provides an antibacterial textile; the antibacterial treatment fluid includes an aloe extract and a polyquaternary ammonium salt. The aloe extract is a kind of natural anti-acne and anti-inflammatory active ingredient, and has good antibacterial effects in the presence of polyquaternary ammonium salts. The antibacterial treatment fluid may be used for the antibacterial treatment of yarns or fibers, and also may be directly used as a spinning solution to spin an antibacterial PQAS/aloe fiber. When the antibacterial treatment fluid serves as a spinning solution for spinning, a sulfonate needs to be added as a surfactant to further improve the flexibility of the fiber after spinning, improve the surface hydrophilia and comfortable feeling. Carboxymethyl chitosan is added to effectively maintain the stability and spinnability of the spinning solution, and further to ensure the antibacterial property of the fiber after spinning. Polyvinyl alcohol is added to maintain the stability of the system and regulate the concentration of the spinning solution, thus being suitable for the subsequent spinning operation. Moreover, raw material ingredients provided by the present invention have extensive sources, low cost and safe and eco-friendly; and the present invention has a preparation method and is easy in operation and thus, can be widely applied in industrial production. Other features and beneficial effects can be referring to the disclosure of the claims and description disclosed in the present invention.

DESCRIPTION OF THE PREFERRED EMBODIMENTS

The present invention will be further described by the following examples. But it should be indicated that the specific material ratios, process conditions, results and the like described in the examples of the present invention are merely used to specify the present invention, but not construed as limiting the protection scope of the present invention. Moreover, any equivalent alteration or modification made according to the spirit of the present invention shall fall within the protection scope of the present invention. It should be noted that unless otherwise specified, "%" described herein refers to "part by mass".

It should be indicated that the graphical representation provided in the examples merely illustrates the basic concept of the present invention via a schematic way, namely, the graphical representation only shows the components related to the present invention, but is not drawn according to the number, shape and size of the components in practical implementation. The shape/form, quantity and proportion of each component during practical implementation may be an optional alteration, and its layout form of the component may be also more complex.

In this present invention, it should be indicated that if there are terms "center", "upper", "lower", "left", "right", "vertical", "horizontal", "inner", "outer", and the like, the direction or position relations indicated thereby are the direction or position relations as shown on the basis of the accompanying drawings, which is only convenient for describing the present invention and simplifying the description instead of indicating or implying that the indicated device or element must have the specific position, be constructed and operated according to the specific position and thus, cannot be construed as limiting the present application. Moreover, the term "first", "second" is only used for description and distinguishing if any, but not construed as indicating or implying relative importance.

An antibacterial textile provided by the present invention may be made or cut into, including but not limited to, bedding packages, such as bed sheet, bedding bag, pillow case, fitted sheet, mosquito net, blanket, throw pillow, and cushion cover; quilts, such as pillow and quilt; bed mattress; household supplies, such as leisurewear, underclothes/socks, curtain, fabric art, back cushion and carpet; bathroom accessories, such as towel, bath towel and hair-drying cap; the household textile may be mainly applied in families and public places, such as guesthouses, hotels, theaters, ballrooms, airplanes, trains, automobiles, ships, shopping malls, companies, institutions and many other occasions. The antiviral textile has excellent bacterium inhibition effects, for example, *Staphylococcus aureus* (MRSA) and Pathogenic *Escherichia coli*, and antiviral effects, for example, anticoronavirus, e.g., MERS-CoV, HCoV-HKU1 and SARS-CoV.

Figure 1:
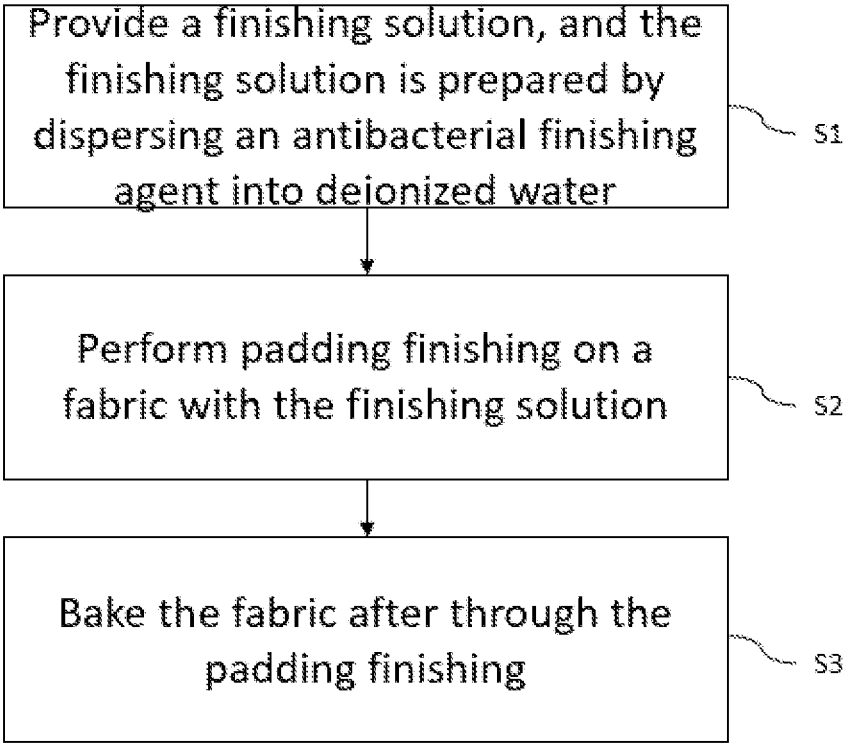
FIG. 1 is a schematic diagram showing preparation process of an antibacterial fabric disclosed in the examples of the present invention.

As shown in FIG. 1, in a detailed embodiment disclosed herein, polyurethane emulsion, charged diatomite, foaming agent and organosilicon coupling agent serve as an antibacterial finishing agent, the fabric is finished by a finishing fluid containing the antibacterial finishing agent to obtain the antibacterial textile. The finishing method of the fabric includes but not limited to the following method:

step S1, providing a finishing solution, where the finishing solution is prepared by dispersing an antibacterial finishing agent into deionized water;

step S2, performing padding finishing on the fabric with the finishing solution;

step S3, baking the fabric after through the padding finishing.

Figure 2:
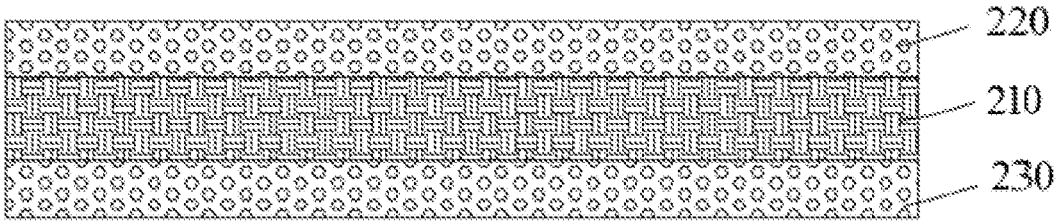
FIG. 2 is a schematic diagram showing a structure of the antibacterial fabric disclosed in the examples of the present invention.

As shown in FIGS. 1-2, in the steps S1-S3, the antibacterial finishing agent uses the polyurethane emulsion, charged diatomite, foaming agent and organosilicon coupling agent as a finishing agent, thus forming finishing membranes 220 and 230 on the surface of the fabric 210 when the fabric is finished by the antibacterial finishing agent to ensure the bonding force on the fabric. The interlayer adhesion is greater than and equal to 10 N/cm. Further, virus is adsorbed and immobilized on the fabric based on these finishing agents to be fully inactivated; particularly, in the early stage of viral transmission, the virus can be inhibited effectively to interrupt transmission, thus protecting human health.

As shown in FIG. 1, the antibacterial finishing agent is obtained by mixing aqueous polyurethane emulsion, organosilicon foaming agent, charged diatomite, organosilicon coupling agent and at least one auxiliary.

As shown in FIG. 1, the aqueous polyurethane emulsion is obtained by, for example, adding a hydrophilic chain extender and small-molecule chain extender after reacting polyhydric alcohol with a polyisocyanate to obtain a prepolymer. The aqueous polyurethane emulsion has a solid content of 38-42%, for example, 40%, a pH value of 6-8, for example, 7. Further, the aqueous polyurethane emulsion has a viscosity of 200-500 mPa·S, for example, 220 mPa·S and 340 mPa·S, thus ensuring the solution viscosity and adhesion to the fabric during the process of dipping the fabric. Further, on the basis of obtaining the expected adhesion, the aqueous polyurethane in the aqueous polyurethane emulsion is cationic aliphatic aqueous polyurethane resin having a molecular weight of 2000-100000 g/mol, for example, 30000 g/mol and 80000 g/mol.

In the composition of the antibacterial finishing agent of the present invention, the aqueous polyurethane emulsion is present as a major adhesive component. Based on the total content of the components constituting the composition of the antibacterial finishing agent, the aqueous polyurethane emulsion has a content of 50-80 wt %, further, for example, may be 55-80 wt %, for example, 58 wt %, 60 wt % and 70 wt %.

As shown in FIGS. 1 and 2, the organosilicon foaming agent is used for foaming the composition of the antibacterial finishing agent such that the finishing membranes 220 and 230 have a porous structure in the process of dipping onto a fabric 210 to ensure the immobilization and adsorption to virus molecules, thus further facilitating inactivation of virus. The organosilicon foaming agent is, for example, a chain-segment structure (—(Si—O)n—) polymer containing organosiloxane; the side chain of the chain segment is a hydrocarbon linked to silicon atom or hydrocarbon-substituted organic group, may be methyl, vinyl or other groups. The chain segment structure n of the organosiloxane is, for example, 100-400, for example, 120 and 300, thereby ensuring the length and molecular weight of the polymer molecular chain as well as the foaming effect and air permeability. By the foaming effect of the organosilicon foaming agent provided herein, the antibacterial finishing agent has a forming diameter on the fabric layer of, for example, 0.01-0.1 mm, for example, 0.01 mm, 0.06 mm and 0.1 mm. Therefore, only gas molecule is allowed to pass through, while water molecule and virus are not allowed to pass through, exerting the effect of ventilation.

In the composition of the antibacterial finishing agent of the present invention, the organosilicon foaming agent is present as a foaming agent. Based on the total content of the components constituting the composition of the antibacterial finishing agent, the organosilicon foaming agent has a content of 5-10 wt %, further, for example, 5 wt %, for example, 6 wt %, and 8 wt %.

As shown in FIG. 1, the charged diatomite has inactivation effect of virus. The charged diatomite particle has a particle size of 28-40 um, for example, 28 um, 30 um, 35 um and 40 um. Further, The charged diatomite particle has lots of silicon hydroxy and hydrogen bonds such that secondary bonds in protein molecules are damaged to cause protein denaturation, thus nonspecifically absorbing and inactivating the virus. Further, the charged diatomite has a hydroxy content of 0.10-0.28 mmol/g, for example, 0.13 mmol/g and 0.21 mmol/g. The charged diatomite has a porosity of 70-90%, thus ensuring a large external surface area. Further, the charge is positive charge, for example, diatomite may be subjected to surface modification under acidic conditions such that the hydroxy on the surface thereof is protonized to be positively charged. Further, negatively-charged activated virus may be inactivated. Diatom of the diatomite may be, for example, *Coscinodiscus, Melosira granulate, Stephanodiscus hantzschii, Cocconeis, Fragilaria*, and *Cyclotella*, and is not defined specifically.

In the composition of the antibacterial finishing agent of the present invention, based on the total content of the components constituting the composition of the antibacterial finishing agent, the charged diatomite has a content of 10-30 wt %, for example, 12 wt %, for example, 13 wt %, and 24 wt %.

As shown in FIG. 1, the organosilicon coupling agent has a coupling effect on the components of the antibacterial finishing agent. The organosilicon coupling agent is, for example, γ-glycidoxypropyltrimethoxysilane, which has good compatibility with other components, thus being beneficial to the coupling. Based on the total content of the components constituting the composition of the antibacterial finishing agent, the organosilicon coupling agent has a content of 1-5 wt %, for example, 1 wt %, for example, 2 wt %, and 4 wt %.

As shown in FIG. 1, the composition of the antibacterial finishing agent further includes at least one auxiliary, for example, an adhesion promoter, a defoaming agent, a dispersing agent and the like, thus ensuring the properties of the antibacterial finishing agent. Based on the total content of the components constituting the composition of the antibacterial finishing agent, the auxiliary has a content of 2-30 wt %, for example, 2 wt %, for example, 10 wt %, and 20 wt %.

As shown in FIG. 1, the composition of the antibacterial finishing agent may further include fibroin, thus further improving the adhesion and compatibility of the antibacterial finishing agent to the fabric 210. Based on the content of the components of the antibacterial finishing agent, the fibroin has content of 5-15 wt %. Further, in some examples, the composition of the antibacterial finishing agent may further include (methyl)acrylic acid polymers and organosilicon polymers, thus ensuring the bonding effect of the antibacterial finishing agent and adsorption and inactivation effects to virus. The content of the (methyl)acrylic acid polymers and organosilicon polymers may be added according to the actual demands and is not limited specifically, for example, respectively, 0-10 wt %, 0-10 wt %, for example, 3 wt %, 5 wt % and 8 wt %.

As shown in FIG. 1, in the step S1, the above each component is stirred and dispersed into deionized water to obtain a finishing fluid. In the premise of not breaking the interior structure of each component and not causing other unexpected phenomena, the stirring rate of the dispersing process may be 100 r/min-300 r/min, for example, 150 r/min; the finishing fluid may have a concentration of 50 g/L-1000 g/L, for example, 500 g/L and 600 g/L, and may be adjusted according to the actual demands.

As shown in FIG. 1, in the step S1, the present invention respectively shows multiple detailed embodiments of the fabric 210. These fabrics may be non-woven fabrics (namely, nonwovens), and definitely not limited thereto. The fabric 210 may be further made into woven fabrics by some antibacterial fibers or antibacterial yarns, and may be further suitable for the use occasions of specific home textiles. These antibacterial fibers or antibacterial yarns may be subjected to warping or wefting, and is not limited specifically. In the process of forming the fabric 210, at least one of these fibers may be a fiber with antibacterial functions, and the fiber with antibacterial functions is obtained by the treatment of the antibacterial treatment fluid. Therefore, the fabric 210 has antibacterial functions, thus ensuring the promotion in the antibacterial and antiviral effects of the antibacterial finishing agent. It should be indicated that these fibers with antibacterial functions, definitely, have unique antibacterial functions without the finishing of the antibacterial finishing agent provided herein; similarly, even though the fabric 210 has no antibacterial function, the antibacterial and antiviral finishing effects of the antibacterial finishing agent provided herein on ordinary fabrics will be not limited.

Figure 3:
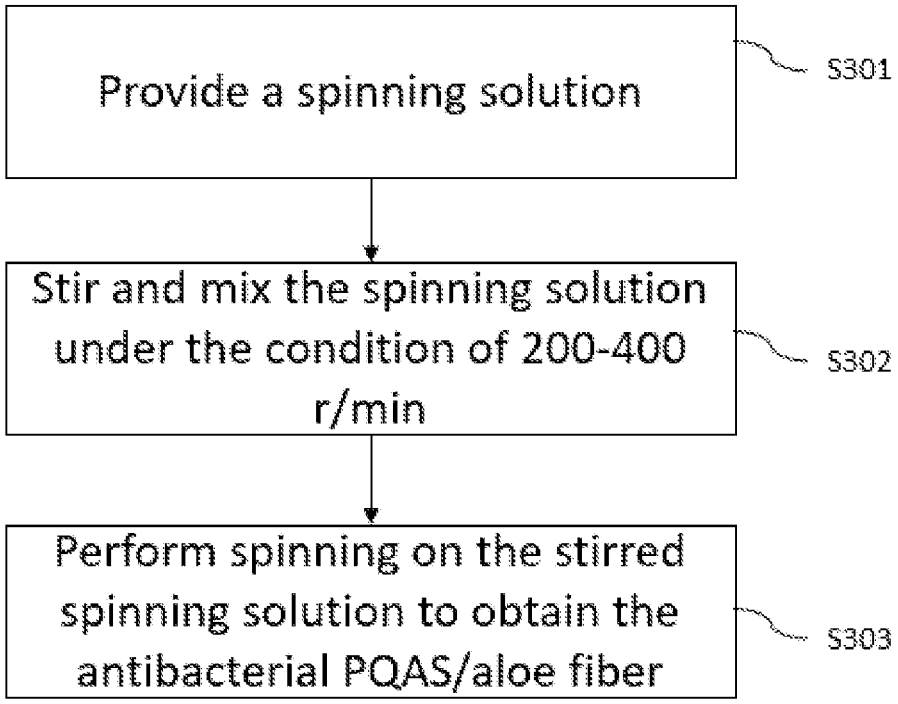
FIG. 3 is a flow diagram showing a preparation method of an antibacterial polyquaternary ammonium salt/aloe fiber disclosed in the examples of the present invention.
Figure 4:
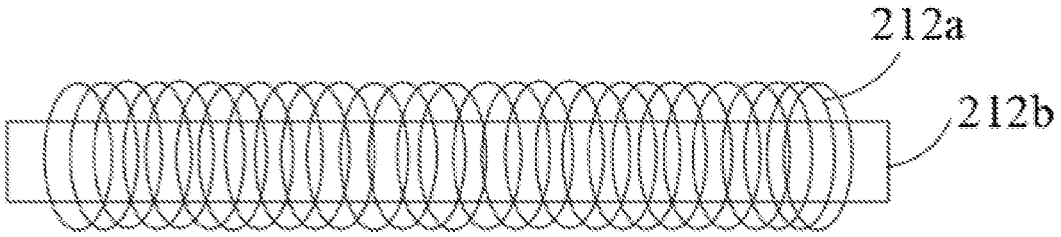
FIG. 4 is a schematic diagram showing a structure of an antibacterial towel disclosed in the examples of the present invention.

As shown in FIGS. 3-4, the antibacterial fabric 210, may be, for example, an antibacterial PQAS/aloe fiber. The antibacterial PQAS/aloe fiber is obtained by spinning via a spinning solution containing PQAS and aloe extract, and has anti-acne, anti-inflammatory and antibacterial effects. The present invention discloses a method for preparing the above antibacterial PQAS/aloe fiber, including but not limited to the following steps of:

step S301, providing a spinning solution (antibacterial treatment fluid), where the spinning solution includes the following parts by weight of components:

3-10 wt % carboxymethyl chitosan, 0.01-0.1 wt % PQAS, 15-30 wt % aloe extract, 10-50 wt % polyvinyl alcohol, 1.5-5 wt % sulfonate, 3-10 wt % alcohol and balance deionized water;

step S302, stirring and mixing the spinning solution under the condition of 200-400 r/m in;

step S303, performing spinning on the stirred spinning solution, where the spinning pressure is 0.2-0.4 MPa and spinning temperature is 40-60° C.; after yielding silk, successively performing drawing, consolidation forming, washing and drying steps to obtain the antibacterial PQAS/aloe fiber.

As shown in FIG. 3, in the step S301, PQAS, aloe extract and sulfonate in the spinning solution serve as active ingredients, and carboxymethyl chitosan is further compounded to have strong inhibiting effects on bacteria, for example, *Staphylococcus* and *Escherichia coli*, thus further exerting the effect of inhibiting inflammatory factors and facilitating the repair of the damaged skin. Specific examples of the PQAS may be, for example, polyquaternary ammonium salt-6, polyquaternary ammonium salt-7, polyquaternary ammonium salt-10, polyquaternary ammonium salt-22, polyquaternary ammonium salt-39, polyquaternary ammonium salt-47, and polyquaternary ammonium salt-76. These materials may be used alone or combined in use, for example, may be polyquaternary ammonium salt-6 and polyquaternary ammonium salt-22. At this time, the compounding of the two components may exert the antibacterial effect better, and the compounding proportion is (20-40):(60-80), for example, 35:65 and 40:60. The use ratio of the polyquaternary ammonium salt is lower than that of the polyquaternary ammonium salt-22. The antibacterial system has better stability and may exert higher antibacterial effect in a lower use amount in the spinning solution. The polyquaternary ammonium salt has a use amount of 0.01-0.1 wt %, further, may be 0.05-0.078 wt %, for example, 0.062 wt % and 0.072 wt %.

The aloe extract in the spinning solution is a kind of natural anti-acne and anti-inflammatory active ingredient, and good antibacterial effects in the presence of polyquaternary ammonium salts. The antibacterial rate may be greater than or equal to 70%; the aloe extract has a use amount of 15-30 wt %, for example, 18 wt % and 20 wt %.

As a surfactant, the sulfonate in the spinning solution may further enhance the flexibility of the spined fiber, improve the surface hydrophilia and comfortable feeling. Specifically, the sulfonate may be listed, tetraethylammonium perfluoroethane sulfonate, potassium diphenylsulfone sulfonate, potassium perfluoroalkyl sulfonate, benzenesulfonyl phenylsulfonyl potassium, sodium p-toluenesulfonate, for example, potassium diphenylsulfone sulfonate. The sulfonate has a content of 1.5-5 wt %, further, 2.0-4.2 wt %, for example, 2.3 wt % and 4.0 wt %.

Different from conventional chitosan, the carboxymethyl chitosan is an ampholytic polyelectrolyte. The carboxymethyl chitosan can effectively maintain the stability and spinnability of the spinning solution, and meanwhile, ensure the antibacterial properties of the spined fiber. The carboxymethyl chitosan has a use amount of 3-10 wt %, for example, 3 wt %. Further, the spinning solution further includes polyvinyl alcohol which is a water-soluble high-molecular polymer used for maintaining the stability of the system and regulating the concentration of the spinning solution, thus being suitable for the subsequent spinning operations. The polyvinyl alcohol has a weight-average molecular weight of 2000-200000 g/mol, further, 2000-8000 g/mol, for example, 4000 g/mol and 6000 g/mol; the polyvinyl alcohol can be more beneficial to regulating the desired concentration of the spinning solution instead of being out of control within the scope. Moreover, the present invention has good biocompatibility and may promote the repair of the inflammatory skin caused by acne. The spinning solution may further include alcohol, for example, ethanol, and the like, which may enhance the dissolving of the components polyvinyl alcohol and the chitosan to form a uniform solution; the use amount of the alcohol is 3-10 wt %, for example, 5 wt %.

As shown in FIG. 3, in the above step S301, to obtain the spinning solution, the polyvinyl alcohol, the chitosan and the alcohol may be dissolved with the deionized water under the conditions of 60-80° C., 20-70 r/m in, for example, 60° C., 60 r/min, and then cooled to room temperature, then the polyquaternary ammonium salt, the sulfonate and the aloe extract are continuously added and stirred at 10-100 r/min, thus obtaining the spinning solution.

As shown in FIG. 3, the step S302 is then implemented; the above spinning solution is continuously stirred; at this time, the stirring rate may be appropriately increased to 200-400 r/min, for example, 250 r/min and 350 r/m in, thereby increasing the viscosity and free of rod-climbing phenomenon.

As shown in FIG. 3, the step S303 is then implemented; the stirred spinning solution is subjected to spinning. The spinning process may be wet spinning. Specifically, the above spinning solution may be added to a reaction still of a wet-spinning frame, and spinning speed is set at 100-110 m/min, for example, 100 m/min, and spinning pressure is set 0.2-0.4 MPa, for example, 0.4 MPa; spinning temperature is set 50-60° C., for example, 60° C., thus always keeping the spinning solution in a good dissolved state, afterwards, the spinning solution is subjected to extrusion molding with a spinneret hole having a diameter of, for example, 0.2 mm; deionized water may be used for a coagulating bath, and the deionized water has temperature of 10-15° C., for example, 10° C. ; rapid consolidation forming may be achieved under the coagulating bath to obtain the antibacterial PQAS/aloe fiber. Definitely, it is not limited thereto, and an acid bath may be available; the acid bath is, for example, 110-120 g/L H2SO4, 12-14 g/L ZnSO4, 245-255 g/L Na2SO4, for example, 110 g/L H2SO4, 12 g/L ZnSO4 and 245 g/L Na2SO4; the acid bath temperature is 55-60° C.; afterwards, the spinning solution may be treated by a drafting system, a cleaning bath, a drying machine and batching device in turn to obtain the antibacterial PQAS/aloe fiber.

As shown in FIG. 4, the antibacterial PQAS/aloe fiber is particularly suitable for home textiles, for example, beddings, bath towels, face towels, and hand towels. The antibacterial PQAS/aloe fiber may be blended with other natural fibers to finally form a terry layer 212*a* around a base layer 212*b* in a towel product, thus being in direct frictional contact with skin. Such kind of textile touches soft. The blending process may be as follows, for example, the antibacterial PQAS/aloe fiber and other fibers, for example, natural fibers, are wound around a threading roll of a blending machine for weaving, and then drafted, washed and dried to obtain the compound fiber fabric. The compound fabric has obvious antibacterial effects after being finished by the above antibacterial finishing agent, and further decreases the use of the antibacterial PQAS/aloe fiber, thus effectively reducing the cost. Afterwards, the satisfactory fiber fabric may be tested by reference to the Test Method for Antibacterial Properties of Dissoluble Antibacterial/Bacterium-Inhibiting Products in GB15979-2002 *Sanitary Standard on Disposable Sanitation Supplies*. The antibacterial effect of the antibacterial PQAS/aloe fiber on *Escherichia coli, Staphylococcus aureus* and *Propionibacterium acnes* is up to 95% above. further, the fiber breaking force is 0.7-1.2 cN/dtex, for example, 0.9 cN/dtex; the elongation at break is 25-40%, for example, 35%.

As shown in FIG. 4, in the towel product, the antibacterial PQAS/aloe fiber may be any fiber. Based on complementing the demand for toughness in use, the antibacterial PQAS/aloe fiber is multifilament. The natural fiber may enhance the comfort of the towel, for example, natural fibers including silk, cotton, wool, flax, soft wool, hair, cellulose, ramie, hemp, flax, and wood pulp. The towel product including the antibacterial PQAS/aloe fiber provided herein may be further designed and made into printing and cutting velvet towels.

Figure 5:
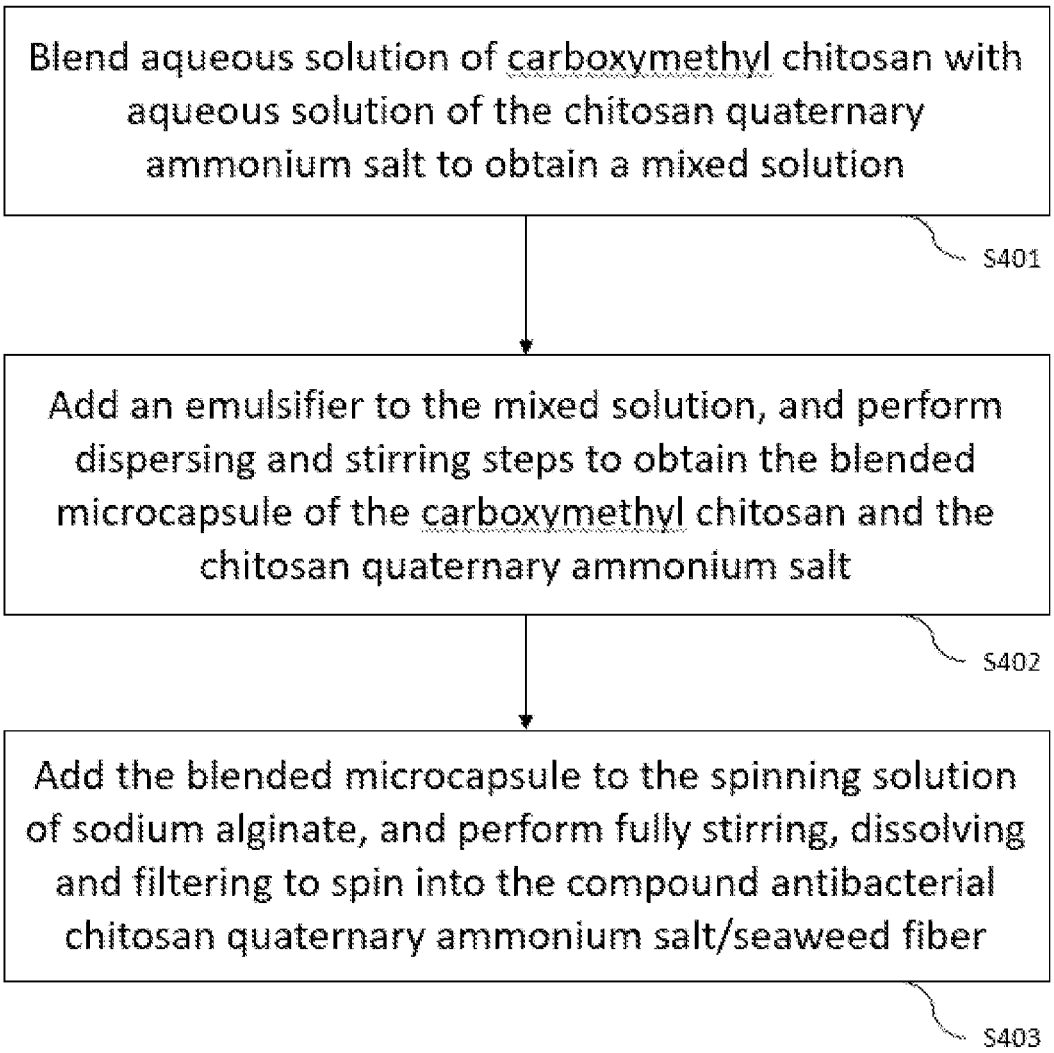
FIG. 5 is a flow diagram showing a preparation method of a compound antibacterial chitosan quaternary ammonium salt/seaweed fiber.

As shown in FIG. 5, in another detailed embodiment of the present invention, the fabric includes, for example, an antibacterial chitosan quaternary ammonium salt/seaweed fiber. The chitosan quaternary ammonium salt of cationic polyelectrolyte and carboxymethyl chitosan are used for form a blended microcapsule. Afterwards, the microcapsule is hardly broken by the subsequent alkali liquor and aqueous solution in the process of spinning with the spinning solution containing sodium alginate of anionic polyelectrolyte, thus overcoming the hard forming problem and avoiding the easy agglomeration and easy fracture of fiber during the direct electrostatic self-assembly process of a single chitosan quaternary ammonium salt and sodium alginate. Based on strong interaction of ionic bonds, the compound antibacterial chitosan quaternary ammonium salt/seaweed fiber provided herein can effectively ensure the structure stability and good mechanical properties of the compound fiber. Meanwhile, due to the excellent moisture absorption of the alginic acid contained in the fiber, the moisture absorption property of the fiber can be improved. Moreover, since the chitosan quaternary ammonium salt and carboxymethyl chitosan have excellent antibacterial properties, the fiber thus has good antibacterial properties. That is, based on the excellent biocompatibility, biodegradablity, strong moisture absorption and comfort of the sodium alginate and the antibacterial properties of the chitosan quaternary ammonium salt, the present invention may be widely applied in home textiles for children, for example, children quilts and children's blankets. The present invention discloses a preparation method of the above compound antibacterial chitosan quaternary ammonium salt/seaweed fiber, including but not limited to the following steps of:

step S401, blending aqueous solution of carboxymethyl chitosan with aqueous solution of the chitosan quaternary ammonium salt to obtain a mixed solution;

step S402, adding an emulsifier to the mixed solution and then performing dispersing and stirring steps to obtain the blended microcapsule of the carboxymethyl chitosan and the chitosan quaternary ammonium salt;

step S403, adding the blended microcapsule to the spinning solution of sodium alginate, fully stirring, dissolving and filtering to spin into the compound antibacterial chitosan quaternary ammonium salt/seaweed fiber.

In the step S401, the carboxymethyl chitosan is an amphipathy polyelectrolyte, and has good mechanical properties and antibacterial functions in the process of blending with the cationic polyelectrolyte, chitosan quaternary ammonium salt. Then, the carboxymethyl chitosan has good shape-coating property in the process of forming a microcapsule, and is hardly broken by the subsequent alkali liquor and aqueous solution in the process of blending with the spinning solution of sodium alginate for spinning. The aqueous solution of the carboxymethyl chitosan has a mass fraction of, for example, 3-10 wt %, for example, 4 wt %, thus keeping the stability and subsequent spinnability of the solution. The mass fraction of the chitosan quaternary ammonium salt may be increased to some extent relative to the aqueous solution of the chitosan quaternary ammonium salt. But in view of cost, the mass fraction should be not too high, for example, may be, 5-20 wt %, for example, 7 wt % and 10 wt %; and the two components may be mixed in a proportion of 1:1 to obtain the mixed solution.

As shown in FIG. 5, in the step S401, the degree of substitution of quaternary ammonium salt in the used chitosan quaternary ammonium salt is less than or equal to 30%; when the degree of substitution is greater than 30%, the degree of substitution of quaternary ammonium salt is excessive and the solubility property is low, which is not beneficial to self-assembled reactions, thus influencing the antibacterial properties. The carbon chain length is 6-12, and the antibacterial properties are obvious within the scope. The carbon chain may break the cell membrane structure of bacteria, thus achieving the purpose of inhibiting bacteria.

As shown in FIG. 5, the step S402 is then implemented. An emulsifier is added to the above mixed solution, for example, a water-in-oil emulsifier, further, may be listed polyglyceryl stearate, sorbitan monolaurate, petroleum sodium sulfonate, alkylbenzene sulfonate, Span 80, lauryl polyoxyethylene ether, and zinc stearate; afterwards, the mixed solution was stirred at 40-60° C. for emulsification for 5-30 min, and subjected to ultrasonic treatment for 20-60min, for example, 30 min, thus obtaining the corresponding blended microcapsule. The adding amount of the emulsifier is 0.1-1% relative to the weight ratio of the mixed solution, thus satisfying the requirements of even emulsification. The emulsified blended microcapsule is dried and collected, then observed under a Malvern Mastersizer or scanning electron microscope; the particle size range is 6-100 nm, further 6-20 nm, for example, 6 nm and 10 nm.

As shown in FIG. 5, the step S403 is then implemented. The above blended microcapsule is added to the spinning solution of sodium alginate, for example, sodium hydroxide solution of sodium alginate, and fully stirred, dissolved and filtered for spinning, where the spinning process may be, for example, wet spinning, and subjected to spinning and forming via for example, a zinc sulfate coagulating bath, then the obtained fiber is cleaned, desulfurated, applied oil and dried to obtain the compound antibacterial chitosan quaternary ammonium salt/seaweed fiber. The sodium alginate is a kind of natural linear polymer by linking β-D-mannuronic acid (M section) to α-L-guluronic acid (G section) via a 1-4 glucosidic bond, and has good antibacterial properties and moisture absorption.

The content of chitosan quaternary ammonium salt and sodium alginate in the compound antibacterial chitosan quaternary ammonium salt/seaweed fiber obtained by the above preparation process may be up to 0.5-1. The chitosan quaternary ammonium salt and sodium alginate have strong acting force therebetween, and are hardly broken in structure in repeated use process. Therefore, the compound antibacterial chitosan quaternary ammonium salt/seaweed fiber has endurable antibacterial and moisture absorption effects, keeps children's skin clear and fresh, and free of invasion of bacterium and the like.

In a further detailed embodiment disclosed herein, the fabric includes, for example, *Lysimachia christinae* Hance fiber, and serves as raw materials together with bamboo fiber, cotton fiber, polyester filament fiber and *Lysimachia christinae* Hance fiber, and a compound antibacterial sizing agent is used for sizing, thus obtaining a textile with antibacterial functions. In the preparation steps of *Lysimachia christinae* Hance fiber, toxicity of *Lysimachia christinae* Hance is removed by caustic soda dissolving and ripening treatment. The prepared *Lysimachia christinae* Hance fiber is non-toxic and keeps anti-inflammatory efficiency, and compounded with the compound antibacterial sizing agent; *Lysimachia christinae* Hance is wrapped into the antibacterial sizing agent to exert a better antibacterial effect. By testing, the antibacterial ratio of the textile fabric is still greater than 85% after being cleaned for 100 times. The antibacterial *Lysimachia christinae* Hance textile fabric is comfortable and breathable, has soft, delicate and smooth hand feel, a washing dimensional shrinkage lower than 2%, strong washability, and durable effects; the textile fabric is particularly suitable for the production of underwear products.

The present invention discloses a method for preparing the above antibacterial *Lysimachia christinae* Hance fiber textile fabric. Bamboo fiber, cotton fiber, polyester filament fiber and *Lysimachia christinae* Hance fiber are used and blended into a yarn, then the yarn is subjected to sectional warping to be prepared into a loom beam; a compound antibacterial sizing agent is used for sizing and airing to produce a raw *Lysimachia christinae* Hance fiber fabric on a shuttle loom; and the raw fabric is subjected to fabric pre-finishing, printing and dyeing treatment and post-finishing; where the compound antibacterial sizing agent includes the following parts by weight of components: 1-3 parts of copper complex of ethylenediamine, 10-30 parts of organosilicon quaternary ammonium salt, 2-5 parts of polyhexamethylene guanidine hydrochloride, 75-80 parts of ethanol and 45-60 parts of water.

The weight ratios of the bamboo fiber to the cotton fiber, the polyester filament fiber and the *Lysimachia christinae* Hance fiber are (15-21):(37-45):(12-18):(1-5). The compound antibacterial finishing agent has a concentration of 2-5 g/L. The organosilicon quaternary ammonium salt is a synthetic product of chloropropyl trimethoxysilane and a long-chain tertiary amine. The polyhexamethylene guanidine hydrochloride is polyhexamethylene monoguanidine hydrochloride or polyhexamethylene diguanidine hydrochloride. The *Lysimachia christinae* Hance fiber is prepared by the following steps of: producing cellulose pulp, and adding caustic soda to the cellulose pulp for aging, then yellowing with carbon disulfide, and adding *Lysimachia christinae* Hance dry powder, porous starch and xanthan gum to be mixed evenly, dissolving with caustic soda, and performing ripening, wet spinning, postprocessing and drying to obtain the finished product. Mass ratios of the cellulose pulp to the *Lysimachia christinae* Hance dry powder, the porous starch and the xanthan gum are 100:(25-35):(12-20):(6-10). The fabric pre-finishing step includes sizing, desizing and bleaching. A water-soluble sizing agent is used in the sizing; type and part by weight of each component in the water-soluble sizing agent are as follows: 100 parts of water, 10-20 parts of ethylene glycol, 6-10 parts of trimethyl acetate, 2-7 parts of sodium acetate, 0.5-2 parts of antimonous oxide, 6-10 parts of starch, 0.8-3 parts of penetrating agent and 4-8 parts of silicone oil. Reactive print is used in the printing and dyeing treatment; further, in the printing and dyeing treatment, a steaming temperature is 100° C-110° C., and time is 10-12 min. Furthermore, the post-finishing includes softening and shaping; a hydrophilic softening agent is taken for the softening. The antibacterial *Lysimachia christinae* Hance fiber textile fabric is obtained.

EXAMPLES

The present invention will be described more specifically by reference to detailed examples.

Example 1

This example discloses a method for preparing an antibacterial *Lysimachia christinae* Hance fiber textile fabric, including the following steps:

1) preparation of *Lysimachia christinae* Hance fiber: cellulose pulp was prepared, and added with caustic soda for aging, then yellowed with carbon disulfide, and added with *Lysimachia christinae* Hance dry powder, porous starch and xanthan gum to be mixed evenly, dissolved with caustic soda, and ripened, and subjected to wet spinning, postprocessed and dried to obtain the *Lysimachia christinae* Hance fiber; where the weight ratios of the cellulose pulp to caustic soda and carbon disulfide were 100:9:7. Mass ratios of the cellulose pulp to the *Lysimachia christinae* Hance dry powder, the porous starch and the xanthan gum were 100:25:12:6.
2) Bamboo fiber, cotton fiber, polyester filament fiber and *Lysimachia christinae* Hance fiber were used and blended into a yarn, then the yarn was subjected to sectional warping to be prepared into a loom beam; a compound antibacterial sizing agent was used for sizing and airing to produce a raw *Lysimachia christinae* Hance fiber fabric on a shuttle loom; and the raw fabric was subjected to fabric pre-finishing, printing and dyeing treatment and post-finishing to obtain the antibacterial *Lysimachia christinae* Hance fiber textile fabric.

In the step 2), the weight ratios of the bamboo fiber to the cotton fiber, the polyester filament fiber and the *Lysimachia christinae* Hance fiber were 15:37:12:1.

In the step 2), the compound antibacterial finishing agent had a concentration of 3 g/L.

In the step 2), the compound antibacterial sizing agent included the following parts by weight of components: 1 part of copper complex of ethylenediamine, parts of organosilicon quaternary ammonium salt, 2 parts of polyhexamethylene guanidine hydrochloride, 75 parts of ethanol and 45 parts of water. The organosilicon quaternary ammonium salt was a synthetic product of chloropropyl trimethoxysilane and a long-chain tertiary amine; the polyhexamethylene guanidine hydrochloride was polyhexamethylene monoguanidine hydrochloride.

In the step 2), the fabric pre-finishing step included sizing, desizing and bleaching.

Specifically, a water-soluble sizing agent was used in the sizing; type and part by weight of each component in the water-soluble sizing agent were as follows: 100 parts of water, 10 parts of ethylene glycol, 6 parts of trimethyl acetate, 2 parts of sodium acetate, 0.5 parts of antimonous oxide, 6 parts of starch, 0.8 parts of penetrating agent and 4 parts of silicone oil.

Specifically, desizing was performed with a weak base having pH<8.

Specifically, aqueous solution of sodium hypochlorite was used as a bleaching liquor in the bleaching process.

In the step 2), reactive print was used in the printing and dyeing treatment. In the printing and dyeing treatment, a steaming temperature was 100° C., and time was 10 min.

In the step 2), the post-finishing included softening and shaping; a hydrophilic softening agent was taken for the softening. Further, the softening agent was dialkyl dimethyl quarternary ammonium salt.

Example 2

This example discloses a method for preparing an antibacterial *Lysimachia christinae* Hance fiber textile fabric, including the following steps:

1) preparation of *Lysimachia christinae* Hance fiber: cellulose pulp was prepared, and added with caustic soda for aging, then yellowed with carbon disulfide, and added with *Lysimachia christinae* Hance dry powder, porous starch and xanthan gum to be mixed evenly, dissolved with caustic soda, and ripened, and subjected to wet spinning, postprocessed and dried to obtain the *Lysimachia christinae* Hance fiber; where the weight ratios of the cellulose pulp to caustic soda and carbon disulfide were 100:9:7; mass ratios of the cellulose pulp to the *Lysimachia christinae* Hance dry powder, the porous starch and the xanthan gum were 100:30:15:8.
2) Bamboo fiber, cotton fiber, polyester filament fiber and *Lysimachia christinae* Hance fiber were used and blended into a yarn, then the yarn was subjected to sectional warping to be prepared into a loom beam; a compound antibacterial sizing agent was used for sizing and airing to produce a raw *Lysimachia christinae* Hance fiber fabric on a shuttle loom; and the raw fabric was subjected to fabric pre-finishing, printing and dyeing treatment and post-finishing to obtain the antibacterial *Lysimachia christinae* Hance fiber textile fabric.

In the step 2), the weight ratios of the bamboo fiber to the cotton fiber, the polyester filament fiber and the *Lysimachia christinae* Hance fiber were 18:41:15:2.

In the step 2), the compound antibacterial finishing agent had a concentration of 2 g/L.

In the step 2), the compound antibacterial sizing agent included the following parts by weight of components: 2 parts of copper complex of ethylenediamine, parts of organosilicon quaternary ammonium salt, 3 parts of polyhexamethylene guanidine hydrochloride, 76 parts of ethanol and 50 parts of water. The organosilicon quaternary ammonium salt was a synthetic product of chloropropyl trimethoxysilane and a long-chain tertiary amine; the polyhexamethylene guanidine hydrochloride was polyhexamethylene monoguanidine hydrochloride.

In the step 2), the fabric pre-finishing step included sizing, desizing and bleaching.

Specifically, a water-soluble sizing agent was used in the sizing; type and part by weight of each component in the water-soluble sizing agent were as follows: 100 parts of water, 12 parts of ethylene glycol, 7 parts of trimethyl acetate, 3 parts of sodium acetate, 1 part of antimonous oxide, 8 parts of starch, 1 part of penetrating agent and 5 parts of silicone oil.

Specifically, desizing was performed with a weak base having pH<8.

Specifically, aqueous solution of sodium hypochlorite was used as a bleaching liquor in the bleaching process.

In the step 2), reactive print was used in the printing and dyeing treatment. In the printing and dyeing treatment, a steaming temperature was 100° C., and time was 10 min.

In the step 2), the post-finishing included softening and shaping. A hydrophilic softening agent was taken for the softening.

Example 3

This example discloses a method for preparing an antibacterial *Lysimachia christinae* Hance fiber textile fabric, including the following steps:

1) preparation of *Lysimachia christinae* Hance fiber: cellulose pulp was prepared, and added with caustic soda for aging, then yellowed with carbon disulfide, and added with *Lysimachia christinae* Hance dry powder, porous starch and xanthan gum to be mixed evenly, dissolved with caustic soda, and ripened, and subjected to wet spinning, postprocessed and dried to obtain the *Lysimachia christinae* Hance fiber; where the weight ratios of the cellulose pulp to caustic soda and carbon disulfide were 100:9:7. Mass ratios of the cellulose pulp to the *Lysimachia christinae* Hance dry powder, the porous starch and the xanthan gum were 100:32:18:9.
2) Bamboo fiber, cotton fiber, polyester filament fiber and *Lysimachia christinae* Hance fiber were used and blended into a yarn, then the yarn was subjected to sectional warping to be prepared into a loom beam; a compound antibacterial sizing agent was used for sizing and airing to produce a raw *Lysimachia christinae* Hance fiber fabric on a shuttle loom; and the raw fabric was subjected to fabric pre-finishing, printing and dyeing treatment and post-finishing to obtain the antibacterial *Lysimachia christinae* Hance fiber textile fabric.

In the step 2), the weight ratios of the bamboo fiber to the cotton fiber, the polyester filament fiber and the *Lysimachia christinae* Hance fiber were 21:45:18:5.

In the step 2), the compound antibacterial finishing agent had a concentration of 4 g/L.

In the step 2), the compound antibacterial sizing agent included the following parts by weight of components: 3 parts of copper complex of ethylenediamine, parts of organosilicon quaternary ammonium salt, 4 parts of polyhexamethylene guanidine hydrochloride, 78 parts of ethanol and 52 parts of water. The organosilicon quaternary ammonium salt was a synthetic product of chloropropyl trimethoxysilane and a long-chain tertiary amine; the polyhexamethylene guanidine hydrochloride was polyhexamethylene biguanide hydrochloride.

In the step 2), the fabric pre-finishing step included sizing, desizing and bleaching.

Specifically, a water-soluble sizing agent was used in the sizing; type and part by weight of each component in the water-soluble sizing agent were as follows: 100 parts of water, 14 parts of ethylene glycol, 8 parts of trimethyl acetate, 4 parts of sodium acetate, 1.5 part of antimonous oxide, 9 parts of starch, 1.5 part of penetrating agent and 6 parts of silicone oil.

Specifically, desizing was performed with a weak base having pH<8.

Specifically, aqueous solution of sodium hypochlorite was used as a bleaching liquor in the bleaching process.

In the step 2), reactive print was used in the printing and dyeing treatment. In the printing and dyeing treatment, a steaming temperature was 110° C., and time was 12 min.

In the step 2), the post-finishing included softening and shaping. A hydrophilic softening agent was taken for the softening.

Example 4

This example discloses a method for preparing an antibacterial *Lysimachia christinae* Hance fiber textile fabric, including the following steps:

1) preparation of *Lysimachia christinae* Hance fiber: cellulose pulp was prepared, and added with caustic soda for aging, then yellowed with carbon disulfide, and added with *Lysimachia christinae* Hance dry powder, porous starch and xanthan gum to be mixed evenly, dissolved with caustic soda, and ripened, and subjected to wet spinning, postprocessed and dried to obtain the *Lysimachia christinae* Hance fiber; where the weight ratios of the cellulose pulp to caustic soda and carbon disulfide were 100:9:7. Mass ratios of the cellulose pulp to the *Lysimachia christinae* Hance dry powder, the porous starch and the xanthan gum were 100:35:20:10.
2) Bamboo fiber, cotton fiber, polyester filament fiber and *Lysimachia christinae* Hance fiber were used and blended into a yarn, then the yarn was subjected to sectional warping to be prepared into a loom beam; a compound antibacterial sizing agent was used for sizing and airing to produce a raw *Lysimachia christinae* Hance fiber fabric on a shuttle loom; and the raw fabric was subjected to fabric pre-finishing, printing and dyeing treatment and post-finishing to obtain the antibacterial *Lysimachia christinae* Hance fiber textile fabric.

In the step 2), the weight ratios of the bamboo fiber to the cotton fiber, the polyester filament fiber and the *Lysimachia christinae* Hance fiber were 21:45:12:4.

In the step 2), the compound antibacterial finishing agent had a concentration of 2 g/L.

In the step 2), the compound antibacterial sizing agent included the following parts by weight of components: 1 parts of copper complex of ethylenediamine, parts of organosilicon quaternary ammonium salt, 5 parts of polyhexamethylene guanidine hydrochloride, 80 parts of ethanol and 56 parts of water. The organosilicon quaternary ammonium salt was a synthetic product of chloropropyl trimethoxysilane and a long-chain tertiary amine; the polyhexamethylene guanidine hydrochloride was polyhexamethylene monoguanidine hydrochloride.

In the step 2), the fabric pre-finishing step included sizing, desizing and bleaching.

Specifically, a water-soluble sizing agent was used in the sizing; type and part by weight of each component in the water-soluble sizing agent were as follows: 100 parts of water, 16 parts of ethylene glycol, 10 parts of trimethyl acetate, 5 parts of sodium acetate, 2 parts of antimonous oxide, 9 parts of starch, 2.5 parts of penetrating agent and 7 parts of silicone oil.

Specifically, desizing was performed with a weak base having pH<8.

Specifically, aqueous solution of sodium hypochlorite was used as a bleaching liquor in the bleaching process.

In the step 2), reactive print was used in the printing and dyeing treatment. In the printing and dyeing treatment, a steaming temperature was 105° C., and time was 10 min.

In the step 2), the post-finishing included softening and shaping. A hydrophilic softening agent was taken for the softening.

Example 5

This example discloses a method for preparing an antibacterial *Lysimachia christinae* Hance fiber textile fabric, including the following steps:

1) preparation of *Lysimachia christinae* Hance fiber: cellulose pulp was prepared, and added with caustic soda for aging, then yellowed with carbon disulfide, and added with *Lysimachia christinae* Hance dry powder, porous starch and xanthan gum to be mixed evenly, dissolved with caustic soda, and ripened, and subjected to wet spinning, postprocessed and dried to obtain the *Lysimachia christinae* Hance fiber; where the weight ratios of the cellulose pulp to caustic soda and carbon disulfide were 100:9:7. Mass ratios of the cellulose pulp to the *Lysimachia christinae* Hance dry powder, the porous starch and the xanthan gum were 100:25:20:10.
2) Bamboo fiber, cotton fiber, polyester filament fiber and *Lysimachia christinae* Hance fiber were used and blended into a yarn, then the yarn was subjected to sectional warping to be prepared into a loom beam; a compound antibacterial sizing agent was used for sizing and airing to produce a raw *Lysimachia christinae* Hance fiber fabric on a shuttle loom; and the raw fabric was subjected to fabric pre-finishing, printing and dyeing treatment and post-finishing to obtain the antibacterial *Lysimachia christinae* Hance fiber textile fabric.

In the step 2), the weight ratios of the bamboo fiber to the cotton fiber, the polyester filament fiber and the *Lysimachia christinae* Hance fiber were 15:37:18:3.

In the step 2), the compound antibacterial finishing agent had a concentration of 5 g/L.

In the step 2), the compound antibacterial sizing agent included the following parts by weight of components: 2 parts of copper complex of ethylenediamine, 30 parts of organosilicon quaternary ammonium salt, 5 parts of polyhexamethylene guanidine hydrochloride, 80 parts of ethanol and 60 parts of water. The organosilicon quaternary ammonium salt was a synthetic product of chloropropyl trimethoxysilane and a long-chain tertiary amine; the polyhexamethylene guanidine hydrochloride was polyhexamethylene monoguanidine hydrochloride.

In the step 2), the fabric pre-finishing step included sizing, desizing and bleaching.

Specifically, a water-soluble sizing agent was used in the sizing; type and part by weight of each component in the water-soluble sizing agent were as follows: 100 parts of water, 18 parts of ethylene glycol, 10 parts of trimethyl acetate, 7 parts of sodium acetate, 2 parts of antimonous oxide, 10 parts of starch, 3 parts of penetrating agent and 8 parts of silicone oil.

Specifically, desizing was performed with a weak base having pH<8.

Specifically, aqueous solution of sodium hypochlorite was used as a bleaching liquor in the bleaching process.

In the step 2), reactive print was used in the printing and dyeing treatment. In the printing and dyeing treatment, a steaming temperature was 110° C., and time was 12 min.

In the step 2), the post-finishing included softening and shaping. A hydrophilic softening agent was taken for the softening.

Test Results

The antibacterial *Lysimachia christinae* Hance fiber textile fabric prepared in Examples 1-5 was subjected to performance test. The test method and test result are as follows.

The antibacterial properties of the finished product fabric were detected by the Part 3: Standards of Oscillation Method in the Evaluation for Antibacterial Properties of Textiles (GB/T 20944.3-2008).

The washing dimensional change rate of the finished product was detected by the Preparation, Labeling and Measurement on Fabrics Samples and Clothing Samples in the Test for the Determination of Dimensional Changes of Textiles (GB/T 8628-2013). The product is qualified when the washing dimensional change rate ranges from −4% to +2%. The softness of the fabric was detected by Determination on the Relative Hand Value of Textiles: Instrumental Method (AATCC 202-2014). The greater the value is, the better the hand feel is. The product washing method was implemented in accordance with the method stipulated in 10.1.2 of GB/T 20944.3-2008.

The specific experiment effect data is shown in the Table below.

| Product | | Example 1 | Example 2 | Example 3 | Example 4 | Example 5 |
|---|---|---|---|---|---|---|
| Softness (SF) | | 85 | 84 | 82 | 86 | 86 |
| Washing dimensional change rate (%) | Warp direction | −1.1 | −1.8 | −1.6 | −1.3 | −1.7 |
| | Weft direction | −0.8 | −1.2 | −1.1 | −0.7 | −1.1 |
| Antibacterial rate before washing (%) | *Escherichia coli* | 93.1 | 93.8 | 93.6 | 92.9 | 92.8 |
| | *Staphylococcus aureus* | 91.2 | 91.5 | 91.7 | 92.1 | 91.6 |
| | *Candida albicans* | 92.2 | 92.5 | 92.6 | 92.1 | 92.5 |
| Antibacterial rate after being washed for 50 times | *Escherichia coli* | 92.1 | 92.2 | 92.4 | 91.6 | 91.6 |
| | *Staphylococcus aureus* | 90.1 | 90.1 | 90.5 | 91.1 | 90.2 |

-continued

| Product | | Example 1 | Example 2 | Example 3 | Example 4 | Example 5 |
|---|---|---|---|---|---|---|
| (%) | *Candida albicans* | 91.1 | 91.2 | 91.3 | 91.0 | 91.1 |
| Antibacterial rate after being washed for 100 times (%) | *Escherichia coli* | 89.1 | 89.5 | 88.5 | 89.1 | 88.2 |
| | *Staphylococcus aureus* | 87.1 | 88.5 | 88.6 | 88.9 | 88.6 |
| | *Candida albicans* | 86.7 | 87.4 | 87.6 | 87.8 | 88.1 |

To sum up, in this present invention, bamboo fiber, cotton fiber, polyester filament fiber and *Lysimachia christinae* Hance fiber serve as raw materials, and a compound antibacterial sizing agent is used for sizing, thus obtaining a textile with antibacterial functions. In the preparation steps of *Lysimachia christinae* Hance fiber, toxicity of *Lysimachia christinae* Hance is removed by caustic soda dissolving and ripening treatment. The prepared *Lysimachia christinae* Hance fiber is non-toxic and keeps anti-inflammatory efficiency, and compounded with the compound antibacterial sizing agent; *Lysimachia christinae* Hance is wrapped into the antibacterial sizing agent to exert a better antibacterial effect. By testing, the antibacterial ratio of the textile fabric is still greater than 85% after being cleaned for 100 times. The antibacterial *Lysimachia christinae* Hance textile fabric is comfortable and breathable. The antibacterial *Lysimachia christinae* Hance textile fabric has soft, delicate and smooth hand feel, a washing dimensional shrinkage lower than 2%, strong washability and durable effects. Therefore, the present invention effectively overcomes various shortcomings in the prior art and thus, has high industrial values in use.

The above examples are merely illustrative of the principle and efficacy of the present invention, but not construed as limiting the present invention. Any person skilled in the art can make modifications or alterations to the above examples within the spirit and scope of the present invention. Therefore, all the equivalent modifications or alterations accomplished by a person skilled in the art within the spirit and technical idea revealed in the present invention shall be still covered by the claims of the present invention.

What is claimed is:

1. A method for preparing an antibacterial *Lysimachia christinae* Hance fiber textile fabric comprising the steps of blending a bamboo fiber, a cotton fiber, a polyester filament and a *Lysimachia christinae* Hance fiber into a yarn, subjecting the yarn to sectional warping to be prepared into a loop beam, sizing and airing the yarn with a compound bacterial sizing agent to produce a raw *Lysimachia christinae* Hance fiber textile fabric on a shuttle loom, subjecting the raw fabric to pre-finishing, printing and dyeing treatment and post-finishing;

wherein the compound antibacterial sizing agent comprises 1-3 parts by weight (pbw) copper complex of ethylenediamine, 10-30 pbw organosilicon quaternary ammonium salt, 2-5 pbw polyhexamethylene guanidine hydrochloride, 75-80 pbw ethanol and 45-60 pbw water.

2. The method for preparing an antibacterial *Lysimachia christinae* Hance fiber textile fabric according to claim 1, wherein the compound antibacterial sizing agent has a concentration of 2-5 g/L.

3. The method for preparing an antibacterial *Lysimachia christinae* Hance fiber textile fabric according to claim 1, wherein the organosilicon quaternary ammonium salt is a synthetic product of chloropropyl trimethoxysilane and a tertiary amine;

and/or, the polyhexamethylene guanidine hydrochloride is polyhexamethylene monoguanidine hydrochloride or polyhexamethylene diguanidine hydrochloride.

4. The method for preparing an antibacterial *Lysimachia christinae* Hance fiber textile fabric according to claim 1, wherein the *Lysimachia* christinae Hance fiber is prepared by the following steps: producing cellulose pulp, and adding caustic soda to the cellulose pulp for aging, then yellowing with carbon disulfide, and adding *Lysimachia christinae* Hance dry powder, porous starch and xanthan gum to be mixed evenly, dissolving with caustic soda, and performing ripening, wet spinning, postprocessing and drying to obtain a finished product.

5. The method for preparing an antibacterial *Lysimachia christinae* Hance fiber textile fabric according to claim 4, wherein mass ratios of the cellulose pulp to the *Lysimachia christinae* Hance dry powder, the porous starch and the xanthan gum are 100:(25-35):(12-20):(6-10).

6. The method for preparing an antibacterial *Lysimachia christinae* Hance fiber textile fabric according to claim 1, wherein the fabric pre-finishing comprises sizing, desizing and bleaching.

7. The method for preparing an antibacterial *Lysimachia christinae* Hance fiber textile fabric according to claim 6, wherein a water-soluble sizing agent used in the sizing; wherein the water-soluble sizing agent comprises 100 pbw water, 10-20 pbw ethylene glycol, 6-10 pbw trimethyl acetate, 2-7 pbw sodium acetate, 0.5-2 pbw antimonous oxide, 6-10 pbw starch, 0.8-3 pbw penetrating agent and 4-8 pbw silicone oil.

8. The method for preparing an antibacterial *Lysimachia christinae* Hance fiber textile fabric according to claim 1, wherein reactive print is used in the printing and dyeing treatment;

and/or, wherein the printing and dyeing treatment comprises steaming at a temperature of 100° C.-110° C. and a time of 10-12 min.

9. The method for preparing an antibacterial *Lysimachia christinae* Hance fiber textile fabric according to claim 1, wherein the post-finishing comprises softening and shaping;

wherein the softening is performed with a hydrophilic softening agent.

10. An antibacterial *Lysimachia christinae* Hance fiber textile fabric prepared by the method claim 1.

* * * * *